United States Patent [19]

Nagata et al.

[11] 4,335,677

[45] Jun. 22, 1982

[54] COATING OF THE INNER SURFACE OF TUBES

[75] Inventors: Koji Nagata; Akio Ogiso; Kyuji Sudo, all of Nagoya, Japan

[73] Assignee: Sumitomo Light Metal Industries, Ltd., Tokyo, Japan

[21] Appl. No.: 183,714

[22] Filed: Sep. 3, 1980

[30] Foreign Application Priority Data

Oct. 25, 1979 [JP] Japan ..... 54-147890[U]

[51] Int. Cl.[3] ..... B05C 7/02

[52] U.S. Cl. ..... 118/306; 118/DIG. 10; 239/406

[58] Field of Search ..... 118/306, 317, DIG. 10; 239/406; 134/166 C, 167 C

[56] References Cited

U.S. PATENT DOCUMENTS 2,520,397 8/1950 Green ..... 118/306
2,886,252 5/1959 Ehrensperger ..... 239/406 X
3,814,330 6/1974 Masters ..... 134/167 C X
4,216,908 8/1980 Sakurai et al. ..... 239/406 X

*Primary Examiner*—John P. McIntosh
*Attorney, Agent, or Firm*—Browdy and Neimark

[57] ABSTRACT

A spray coating tool used for coating the inner surface of a tube. The tool sprays a desired paint through a nozzle while the tool is being shifted inside the tube to be coated along the axis of the same tube. In the nozzle a nozzle insert having a prism portion, on the external surface of which at least one spiral groove is formed, is inscribed to the inner surface of a hollow cylindrical space of a nozzle cap of the above-mentioned nozzle. A plurality of straightly elongated grooves, formed between the inner surface of the nozzle cap and the sides of the prism portion of the nozzle insert, and the spiral groove function to impart atomizing gas a straightly going force and a spirally going force, so as to spirally spray the paint supplied through a paint supply passage extending along the axis of the nozzle insert.

7 Claims, 8 Drawing Figures

COATING OF THE INNER SURFACE OF TUBES

FIELD OF THE INVENTION

This invention relates to an apparatus or a tool for coating the inner surface of tubes, and more particularly to the structure of a novel nozzle which is capable of forming a coated film of uniform thickness either in the circumferential and axial direction on the inner surface of tubes and performing a stable operation even in a continuous coating work.

BACKGROUND OF THE INVENTION

In many power stations or plants a surface condenser passing sea water therethrough has been conventionally utilized for the purpose of cooling the exhaust gas (steam) from a steam turbin for power generating so as to condense it for recycling the same. This type surface condenser has a structure wherein a lots of long condenser tubes, i.e., heat exchanger tubes of small diameter are installed to pass sea water therethrough for cooling the aforementioned steam flowing outside the tubes by the contact heat exchange at the tube walls. Those tubes must be coated on the inner surface thereof with the object of corrosion resistance against sea water. The coating is however strictly conditioned not to deteriorate the heat exchanging performance or function, which is essential to the heat exchanger tubes. It is said that the protective coating of the heat exchanger tubes must be held down in the thickness of the coated film to the order of 10–30$\mu$ and furthermore uniform so as not to spoil the heat transfer property thereof.

One of the known methods of coating the inner surface of a long tube of small diameter throughout the whole length thereof, flowing of paint into the tube is fairly widely practiced. It is however very inconvenient for a tube already installed in a heat exchanger or the like, because the tube in such a situation can not be inclined in the process of flowing out the remnant paint. Making good use of the air spray coating method in the interior coating of a tube is usually limited to a case wherein the internal diameter of the tube is relatively large, the length of the tube is within 5 meters or so, and the thickness of the coated film is allowed as large as 50–200$\mu$. It is therefore employable only for the anti-corrosion coating of a tube used in flowing an ordinary fluid.

In the coating of the heat exchanger tubes (or pipes) for a condenser, so-called condenser tubes, thin and uniform film of coating on the order of 10–30$\mu$ is required; and it must be executed in tubes of internal diameter as small as 10–40 mm$\phi$ and of length as large as 5–40 m. Such a situation has conventionally made the thin and uniform interior coating extremely difficult. Besides, the air spray coating method and apparatus was originally developed for the use over a plane place. It is a very excellent method for coating a plane, but applying the same to the interior of a small diametered tube or pipe is very difficult, because it is not suitable for being shifted through the tube inside while uniformly and thinly coating the curved or circular interior surface.

In a spray gun which has been used in the air spray coating, a nozzle portion is said susceptible to sticking of paint and dust at either the paint passage and air passage. Such sticking of paint and dust to the passages is liable to deteriorate the spraying (atomizing) condition due to the clogging thereof. It makes the spraying unstable, which naturally hampers a continuous and uniform coating to be executed smoothly. Besides, the clogging of the essential portions of the nozzle requires a breaking up for cleaning thereof, giving rise to another problem of increasing the man power to be consumed.

SUMMARY OF THE INVENTION

This invention was made for eliminating the disadvantages of the prior art. The primary object of this invention is therefore to provide an apparatus for effectively and continuously spray coating the inner surface of a tube while being shifted along the inside of the tube.

Another object of this invention is to provide a novel nozzle structure which is capable of forming a coated film of uniform thickness in either circumferential and axial direction on the inner surface of a tube, and stable in paint atomization or nebulization, even when the same is employed in a continuous spray coating operation, without any fear of clogging the nozzle mouth with the paint and dust.

Still another object of this invention is to provide a spray coating apparatus which enables to coat the inner surface of a long tube of small diameter, throughout the whole length thereof in the axial direction, with a paint film of uniform thickness.

Still further object of this invention is to provide an apparatus for forming a protective coating with uniform film thickness of paint in the range 10–30$\mu$, applicable on the inner surface of condenser tubes used in a surface condenser without affecting the heat transfer performance thereof, and a spray gun adapted to this method.

Other objects of this invention will become apparent to those skilled in the art from the following detailed description of the preferred embodiments when read in connection with the accompanying drawings.

The gist of this invention for attaining the abovementioned objects can be summarized as follows. In a spray coating apparatus or a tool, having a spraying nozzle for spraying a coating or paint for being gradually shifted or moved in a tube-to-be-coated while executing the spraying operation, a nozzle insert having a prism portion, on the external surface of which at least one spiral groove being formed, is being inscribed within a hollow cylindrical space of a nozzle cap of the spray nozzle. In a spray nozzle of such a structure, (1) a plurality of straightly extending long spaces or grooves formed between the sides of the prism portion and the inner surface of the nozzle cap, and (2) at least one spiral groove formed on the surface of the prism portion, constitute routes or passages for the atomizing or nebulizing gas so as to impart it a straightly going force and a spirally advancing force. The coating or paint supplied through a hole bored in the central portion of the nozzle insert can be spirally sprayed when leaving the tip or mouth of the spray nozzle.

According to this invention, the atomizing gas is imparted a straight going force and a spiral going force, owing to the straightly elongated grooves, between the prism portion and the inside surface of the nozzle cap, and the spiral groove. The paint can be, due to the double directional atomizing gas, spirally sprayed with a uniform thickness in the circumferential and axial direction of the tube-to-be-coated throughout the entire length thereof. This invention has eliminated the frequent overhauling of the spray nozzle which was conventionally inevitable due to the clogging of paint remnant and dust in the air pocket and other portions of the nozzle. This invention has enabled in this way a stable and continuous spraying operation for a long tube of small diameter, bringing about a good result of thin and uniform thickness of film in all direction of the tube interior. Specifically, in protective coating of condenser tubes used in a surface condenser for a power station, which are as long as 3–40 meters, preferably 5–40 meters and of small diameter such as 10–40 mm$\phi$, this invention is quite effective. This invention is capable of giving a coating film at a thickness of 10–30$\mu$ to a condenser tube of the above-mentioned dimension, without deteriorating the heat transfer function of the tube at all, the most important feature as a heat exchanger.

DETAILED DESCRIPTION OF THE PREFERRED EMBODIMENTS

The preferred embodiments of this invention will be described hereunder with reference to the accompanying drawings. Prior to entering however the explanation of the embodiments some comments on the structure of a conventional spray gun will be made for better understanding of this invention.

In a nozzle portion of a spray gun used in spray coating of conventional type the air to be gushed from an air passage 32, formed around a nozzle insert 31 for embracing the same, is unified and made uniform in an air pocket 33 before being blown out, through a gap d between the tip of the nozzle insert 31 and a nozzle cap 34, together with the paint comming from a paint supplying tube disposed along the axis of the nozzle insert 31 in atomization or nebulization.

The air passage 32, the air pocket 33, and the gap d portion are, during the continuous operation of the spray coating, susceptible to clogging with dregs or remnants of paint, and sometimes with dust, which renders the spray coating operation unstable. It often causes an inevitable disassembling of the nozzle that is removing of the nozzle cap from the nozzle insert 31 for cleaning the clogged portions, which is not only a time-consuming work but also largely defective in rendering the uniform and continuous coating operation impossible.

Figure 2:
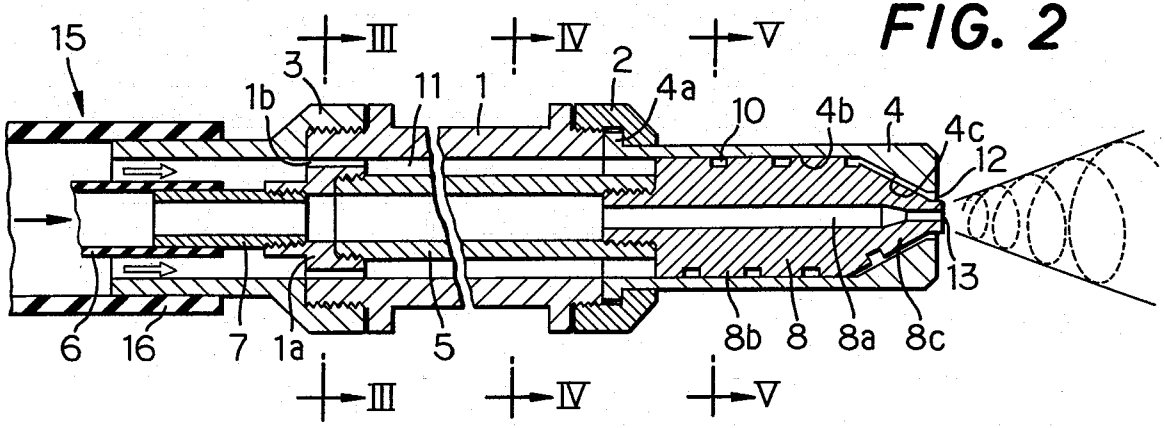
FIG. 2 is an axial sectional view of an essential part of an embodiment of a spray coating apparatus, including a nozzle insert, of this invention.
Figure 4:
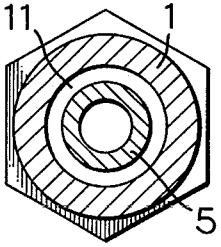
FIGS. 3–5 are respectively a cross-sectional view taken along the section line III—III, IV—IV, and V—V in FIG. 2.

On the contrary, a spray gun in accordance with this invention, shown in FIGS. 2–7, is provided with a cylindrical outer casing 1, which is on either male-screwed end portions thereof threaded by a center guide 2 and 3, as illustrated in FIG. 2. The center guides 2 and 3 are all of hexagonal form in cross section, having a dimension just inscribable in the inner surface of a tube-to-be-coated. The hexagonal edge portions of the center guides 2, 3 are good for guiding the spray gun itself by being slided reciprocally along the inside of the tube.

On one end of the outer casing 1 a nozzle cap 4 is concentrically fastened thereto at a flange 4*a* thereof by the center guide 2.

Figure 6:
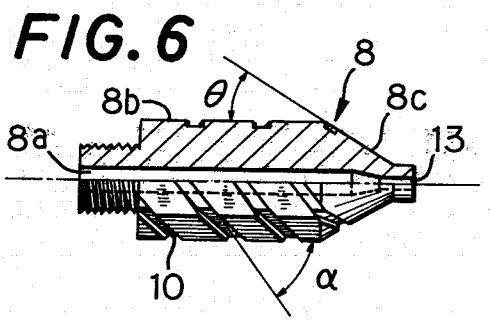
FIG. 6 is an axial sectional view in elevation of a part of the nozzle insert in FIG. 2.
Figure 7:
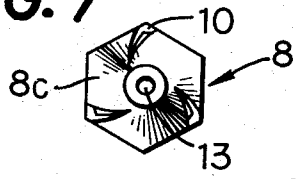
FIG. 7 is a side view seen from right side of the nozzle insert in FIG. 6.
Figure 1:
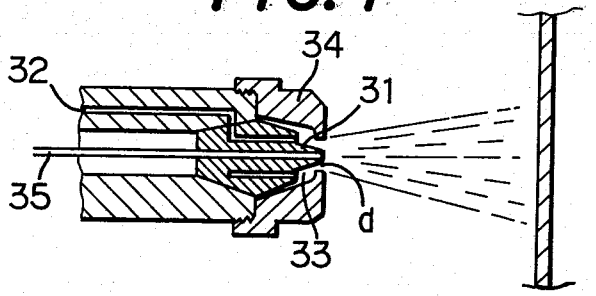
PRIOR ART FIG. 1
FIG. 1 is an axial sectional view of an essential part of a nozzle used in a conventional air spray gun.
Figure 5:
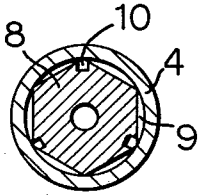
Figure 3:
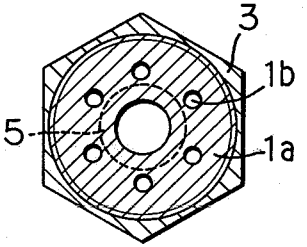

An inner casing 5 having an external diameter smaller than the internal diameter of the outer casing 1 by a predetermined amount is disposed inside, and concentrically with, the outer casing 1. To the right end, in FIG. 2, of the inner casing 5 a nozzle insert 8 having a through bore 8*a* in the axis thereof is threaded into. The nozzle insert 8 is provided with a hexagonal prism portion 8*b* which is inscribable in a hollow cylindrical portion 4*b* of the nozzle cap 4 and a conical portion 8*c* faced to a hollow conical space 4*c* of the nozzle cap 4 with a predetermined gap. Between the inner surface of the hollow cylindrical portion 4*b* and each of six flat sides of the hexagonal prism portion 8*b* six straight but arch ceiling shaped spaces 9 are left lengthwise as seen in FIG. 5; on the surface of the nozzle insert 8 a spiral groove 10 is inscribed with a certain angle $\alpha$ to the axis thereof, as can be seen in FIGS. 6 and 7. It signifies therefore that two kinds of flow passages for the blowing or atomizing gas, for example compressed air, are formed between the nozzle cap 4 and the nozzle insert 8, i.e., the six straightly elongated spaces 9 (which will be called straight grooves) and three spiral grooves 10.

The left end (in FIG. 2) of the inner casing 5 is threaded in a boss 1*a* of the outer casing 1 as to leave a predetermined space 11 between the inner casing 5 and the outer casing 1. Through a suitable number of through-holes 1*b* formed in the boss 1*a* and the space 11, a passage for the atomizing (spraying) gas is made in the direction toward the nozzle cap 4. The atomizing gas is supplied by an air hose 16 attached to the open end of the center guide 3; the air hose 16 is usually made into a double hose 15, containing a paint supply passage 6 therein, for being inserted deep into, and drawn back out of, a tube-to-be-coated. The boss 1*a* is provided with a fitting 7 threaded thereinto, to the other end thereof the paint supply passage 6 being supposed to be connected. The fitting 7, the inner casing 5, and the through-bore 8*a* in the nozzle insert 8 constitute a route for supplying the paint.

In the spray gun of such a structure paint is supplied through an inside route of a double tube formed by the center guide 3 and the fitting 7, and atomizing gas led by the air hose 16 is supplied through an outside route of the double tube. The paint comming through the fitting 7, the inner casing 5, and the through-bore 8*c* of the nozzle insert 8 is supposed to be sprayed out of a tip portion 13 of the through-bore 8*a*; and the blowing gas such as compressed air is led forward through the through-holes 1*b* and the space 11, and is further imparted a straight going force in the straight grooves 9 and a spirally advancing force through the spiral groove 10, before it is blown, getting through the space between the conical portion 8*c* of the nozzle insert 8 and the hollow conical space 4*c* of the nozzle cap 4, out of a gas blowing port 12. This blowing (or spraying) gas atomizes the paint gushing out of the tip portion 13 of the through-bore 8*a* of the nozzle insert 8, while spiraling the same, which enables the paint to be sprayed uniformly toward the inner surface of the tube-to-be-coated. By means of shifting backwards the spray gun itself of this type, once inserted deep through to the other end opening of the tube-to-be-coated, at a constant speed, while spraying the paint in atomization, along the inside of that tube (leftward direction in FIG. 2), coating technology of the inner surface of a long tube of small diameter throughout the entire length thereof has just been established.

Figure 8:
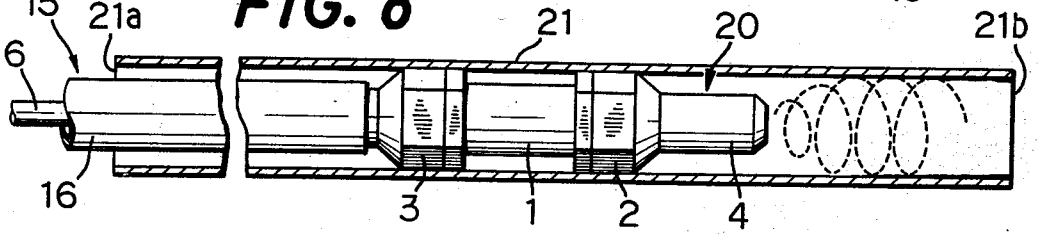
FIG. 8 is a schematic view showing how the inner surface of a condenser tube is coated with the apparatus in FIG. 2 of this invention.

Describing more specifically, for coating the inner surface of a long condenser tube 21 of small diameter, as shown in FIG. 8, a double hose 15, having a spray nozzle 20 of this invention on the tip thereof, is inserted for being kept on pushed deeper into the condenser tube 21 from one end opening 21*a* thereof as far as the other end opening 21*b* throughout the whole length (5–40 m) of the condenser tube 21. The moment when the spray nozzle 20 has reached the other end opening 21*b* of the condenser tube 21 spraying of the paint is commenced in atomization. The paint and the atomizing gas are independently supplied through their respective passage, as mentioned above, before reaching the spray nozzle 20, where the former is sprayed in atomization due to the double directional spraying force of the latter, i.e., straight and spiral. As soon as the spraying of the paint is commenced, the double hose 15 is drawn back while spraying the paint from the spray nozzle 20, by means of a suitable mechanical means, at a predetermined constant speed from the other end opening 21*b* toward the one end opening 21*a* of the condenser tube 21. During this shifting or movement of the spray nozzle 20, due to the drawing back of the double hose 15 through the condenser tube 21, the inner surface thereof is gradually and regularly coated with the atomized paint. The whole length of the condenser tube 21 can thus be coated with a uniform thickness from one end to the other end thereof. When the spray nozzle 20 has returned to the one end opening 21*a*, the supplying of the paint and the atomizing gas is suspended to stop the coating operation. When one condenser tube 21 is finished coating in this way another and a third tube will be coated in order successively in a similar way. By this continuous and repeated protective coating operation, a condenser having a large number of condenser tubes can be coated or re-coated on the inner surface thereof quite smoothly and effectively.

The shape of the spiral groove or grooves 10 formed (inscribed) on the external surface of the nozzle insert 8 may be varied according to the internal diameter of the condenser tube 21 to be coated. It is appropriate in normal cases to determine the twist angle $\alpha$ formed between the spiral groove 10 and the axis of the nozzle insert 8 (see FIG. 6) in the range of 15°–60°. And it is preferable to set the spray angle $\theta$, that is a half of the vertical angle of the conical portion 8*c* of the nozzle insert 8, within the sphere of 5°–45° so as to ensure the best spraying condition at a place 200 mm distant from the tip of the spray nozzle 20.

In the above embodiment the nozzle insert 8 is provided with the hexagonal prism portion 8*b* which is easy in machining, but the shape of this prism portion is by no means limited to the hexagon. It is of course variable in various suitable ways to those skilled in the art, for example, quadrangular or octangular prism and so on, without any hitch.

What is claimed is:

1. A spray coating tool for continuously and gradually coating the inner surface of a tube by means of spraying a paint from a nozzle, while being shifted inside along the axial direction of said tube, in which said nozzle comprises:

a nozzle cap consisting of a hollow cylindrical portion, a hollow conical portion extended therefrom, and a gas blowing opening at a zenith of said hollow conical portion, and a nozzle insert in said nozzle cap, said insert consisting of a prism portion inscribed in said hollow cylindrical portion of said nozzle cap, and provided with at least one spiral groove on the external surface thereof, a conical portion extended from said prism portion, being faced with a small gap to the inner surface of said hollow conical portion of said nozzle cap, and a paint supply passage extending through along the axis of said nozzle insert, whereby atomizing gas which is passed between said nozzle cap and said nozzle insert, being imparted a straight going force by a plurality of straightly elongated grooves formed between the inner surface of said nozzle cap and each of the sides of said prism portion and a spirally going force by said spiral groove or grooves, will be blown through said gas blowing opening so as to spirally spray in atomization the paint supplied through a passage along the axis of said nozzle insert.

2. A coating tool as set forth in claim 1, wherein said prism portion of said nozzle insert is of hexagonal shape in the cross section thereof, and said spiral groove formed on the external surface of said prism portion is slanted to the axial line of said nozzle insert at a twist angle in the range of 15°–60°.

3. A coating tool as set forth in claim 1, wherein the spiral groove formed on the external surface of said prism portion is extended as far as on the conical portion of said nozzle insert such that the spiral flow of the atomizing gas is led to said gas blowing opening of said nozzle cap.

4. A coating tool as set forth in claim 1, wherein the angle of inclination of said conical portion of said nozzle insert to the axis thereof is in the range of 5°–45°.

5. A coating tool as set forth in claim 1 comprising means to coat said tube, wherein said tube to be coated is a long tube of small diameter having the internal diameter in the range of 10–40 millimeters and the length in the range of 3–40 meters.

6. A coating tool as set forth in claim 1, comprising means to coat said tube, wherein said tube to be coated is a condenser tube installed in a surface condenser.

7. A spray coating tool for continuously and gradually coating the inner surface of a tube by means of spraying a desired paint from a nozzle, while being shifted inside along the axial direction of said tube, comprising:

a nozzle cap consisting of a hollow cylindrical portion, a hollow conical portion extended therefrom, and a gas blowing opening formed at a zenith of said hollow conical portion;

a nozzle insert installed in said nozzle cap, consisting of a hexagonal prism portion inscribed in said hollow cylindrical portion of said nozzle cap, and provided with three spiral grooves on the external surface thereof, a conical portion extended from said hexagonal prism portion, being faced with a small gap to the inner surface of said hollow conical portion of said nozzle cap, and a paint supply passage extending through along the axis of said nozzle insert;

an outer cylindrical casing, to which said nozzle cap is connected;

an inner cylindrical casing disposed in said outer cylindrical casing, to which said nozzle insert is connected;

a first center guide, for connecting said nozzle cap to one end of said outer cylindrical casing, being of hexagonal shape in cross section with a dimension suitable to be inscribed to the inner surface of said tube to be coated;

a second center guide fastened to the other end of said outer cylindrical casing, being of hexagonal shape in cross section, with a dimension suitable to be inscribed to the inner surface of said tube to be coated; and a double hose connected via said second center guide to said outer cylindrical casing, whose inner tube being a paint supply passage and outer tube an atomizing gas passage, whereby atomizing gas supplied between said nozzle cap and said nozzle insert, being imparted a straight going force by six straightly elongated grooves formed between the inner surface of said nozzle cap and each of six sides of said hexagonal prism portion and a spirally going force by the three spiral grooves, will be blown through said gas blowing opening so as to spirally spray in atomization the paint supplied from the inner tube of said double hose through to said inner cylindrical casing and the paint supply passage along the axis of said nozzle insert.

* * * * *